US006602655B2

(12) United States Patent
Fitterman et al.

(10) Patent No.: US 6,602,655 B2
(45) Date of Patent: Aug. 5, 2003

(54) BLACK-AND-WHITE DEVELOPING COMPOSITIONS AND METHODS OF USE

(75) Inventors: Alan S. Fitterman, Rochester, NY (US); Joan F. Rachel, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/125,713

(22) Filed: Apr. 18, 2002

(65) Prior Publication Data

US 2002/0168597 A1 Nov. 14, 2002

Related U.S. Application Data

(62) Division of application No. 09/768,675, filed on Jan. 24, 2001, now abandoned.

(51) Int. Cl.[7] ..... G03C 5/30
(52) U.S. Cl. ..... 430/466; 430/489
(58) Field of Search ..... 430/466, 489

(56) References Cited

U.S. PATENT DOCUMENTS

| | | | | |
|---|---|---|---|---|
| 4,269,929 A | 5/1981 | Nothnagle | ..... | 430/264 |
| 4,323,642 A | 4/1982 | Levinson | ..... | 430/438 |
| 4,639,417 A | 1/1987 | Honda et al. | ..... | 430/567 |
| 4,816,384 A | 3/1989 | Fruge et al. | ..... | 430/465 |
| 4,987,060 A | 1/1991 | Marchesano | ..... | 430/434 |
| 5,114,836 A | 5/1992 | Sato et al. | ..... | 430/569 |
| 5,474,878 A | 12/1995 | Sakuma | ..... | 430/401 |
| 5,851,747 A | 12/1998 | Takahashi | ..... | 430/531 |
| 5,981,161 A | 11/1999 | Hosoi | ..... | 430/567 |
| 6,022,675 A | 2/2000 | Fitterman et al. | ..... | 430/456 |

FOREIGN PATENT DOCUMENTS

| | | |
|---|---|---|
| EP | 0 136 582 | 4/1985 |
| EP | 0 307 867 | 3/1989 |
| EP | 0 566 374 A2 | 10/1993 |

*Primary Examiner*—Hoa Van Le
(74) *Attorney, Agent, or Firm*—J. Lanny Tucker

(57) ABSTRACT

A concentrated black-and-white photographic developing composition has improved stability, is compatible with the environment and provides desired sensitometric properties with a combination of particular antifoggants. These antifoggants include a mercapto-substituted tetrazole and a benzimidazole that has one or more electron withdrawing groups. This concentrated composition can be used as a first "part" and mixed, upon dilution, with a diluted second "part" that is a concentrated composition of a gelatin hardening agent. When mixed together, the two diluted concentrates form a working strength developing composition that can be used to provide black-and-white images in various photographic silver halide materials, and particularly in radiographic films.

17 Claims, No Drawings

BLACK-AND-WHITE DEVELOPING COMPOSITIONS AND METHODS OF USE

CROSS-REFERENCE TO RELATED APPLICATION

Divisional of application Ser. No. 09/768,675 filed Jan. 24, 2001, now abandoned.

FIELD OF THE INVENTION

This invention relates in general to photography and in particular to improved black-and-white developing compositions. More particularly, it relates to improved and black-and-white developing compositions and to methods for their use in processing silver halide materials, and particularly radiographic materials.

BACKGROUND OF THE INVENTION

Photographic black-and-white developing compositions containing a silver halide black-and-white developing agent are well known in the photographic art for reducing silver halide grains containing a latent image to yield a developed photographic image. Many useful developing agents are known in the art, with hydroquinone and similar dihydroxybenzene compounds and ascorbic acid (and derivatives) being some of the most common. Such compositions generally contain other components such as sulfites, buffers, antifoggants, halides and hardeners.

Dihydroxybenzenes (such as hydroquinone) are the most common black-and-white developing agents and are quite active to provide development in various black-and-white photographic elements with or without booster and nucleating compounds. Another class of black-and-white developing agents are known in many publications as ascorbic acid and its various derivatives, for example as described in U.S. Pat. No. 5,236,816 (Purol et al).

Efforts have been made to provide an environmentally suited developing composition that would be useful for a wide variety of radiographic films. Such compositions would also increase contrast in black-and-white photographic images and promote a blue or "cold" tone in the processed films. It is also desired to provide such compositions in concentrated form. However, to accomplish all of these results, the composition must be carefully formulated to have all of the desired components in the right proportion, and may have to be supplied in multiple "parts" or formulations that are mixed together for use. In particular, the antifoggant(s) must be chosen carefully so contrast is maximized and are soluble in concentrated solutions.

Some black-and-white developing compositions include a combination of an indazole and benzimidazole antifoggants. Indazoles are described for example, in U.S. Pat. No. 4,323,642 (Levinson). Indazoles are generally dissolved in low pH solutions or in solutions containing glutaraldehyde.

However, it has been difficult to find a combination of antifoggants that are suitably soluble in concentrated solutions and provide the desired sensitometric properties. Thus, there is a need, however, for environmentally suitable black-and-white developing compositions that provide such properties and that can be provided in concentrated form.

SUMMARY OF THE INVENTION

This invention provides an improved concentrated black-and-white photographic developing composition having a pH of at least 9 and comprising:

a) at least 0.6 mol/l of a black-and-white developing agent, b) at least 0.5 mmol/l of a mercapto-substituted tetrazole antifoggant, and c) at least 0.5 mmol/l of a benzimidazole antifoggant having one or more electron withdrawing groups.

This invention also provides a two-component (or two "part") black-and-white developing composition kit comprising:

I) as a first component (or first "part"), the concentrated black-and-white photographic developing composition noted above, and II) a second component (or second "part") comprising a concentrated composition having a pH of at least 3 and comprising at least 0.01 mol/l of a gelatin hardening agent.

Further, this invention provides a working strength black-and-white developing composition provided by mixing the two components I and II noted above, the first component being diluted from about 1 to about 10 times with water, and the second component being diluted from about 10 to about 25 times with water, and the ratio of the diluted first component to the diluted second component being from about 2:1 to about 10:1.

Still again, the present invention provides a working strength black-and-white photographic developing composition having a pH of at least 9 and comprising:

a) at least 0.16 mol/l of a black-and-white developing agent, b) at least 0.1 mmol/l of a mercapto-substituted tetrazole antifoggant, c) at least 0.1 mmol/l of a benzimidazole antifoggant substituted with one or more electron withdrawing groups, and d) if present, at least 0.01 mol/l of a gelatin hardening agent.

A method of providing an image comprises contacting an imagewise exposed silver halide photographic material with a working strength black-and-white photographic developing composition as described above for at least 10 seconds.

We have found that the two-part concentrated developing composition kit can be used to provide a working strength composition that can be used to provide black-and-white images with desired sensitometric properties. The individual concentrated "parts" are stable under typical storage conditions and can be appropriately diluted and mixed to provide this composition. In the "first" part containing the developing agent, we have found that two specific types of antifoggants can be solubilized and mixed to provide desired $D_{min}$, contrast and tone when used in processing. These antifoggants are specific mercapto-substituted tetrazoles and nitro-substituted benzimidazoles. The use of each type of antifoggant presents a unique set of problems that are not evident with the combination of antifoggants.

In addition, the concentrated black-and-white photographic developing composition described above can be used directly for providing an image with or without dilution. Thus, the first "part" described above can be used alone if desired for black-and-white image formation in photographic materials.

DETAILED DESCRIPTION OF THE INVENTION

Definitions

The term "contrast" as herein employed indicates the average contrast (also referred to as $\gamma$) derived from a characteristic curve of a radiographic element using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E(\log_{10}E_2-\log_{10}E_1)$, $E_1$ and $E_2$ being the exposure levels at the reference points (1) and (2).

The term "dual-coated" is employed to indicate radiographic elements having image forming layer units disposed on opposite sides of a support.

The terms "front" and "back" refer to features or elements nearer to and farther from, respectively, the X-radiation source than the support of the radiographic element.

The term "fully forehardened" is employed to indicate the forehardening of hydrophilic colloid layers to a level that limits the weight gain of a radiographic material to less than 120 percent of its original (dry) weight in the course of wet processing. The weight gain is almost entirely attributable to the ingestion of water during such processing.

The term "rapid access processing" is employed to indicate dry-to-dry processing of a radiographic element in 45 seconds or less. That is, 45 seconds or less elapse from the time a dry imagewise exposed radiographic element enters a wet processor until it emerges as a dry fully processed element.

In all references to silver halide grains and emulsions containing two or more halides, the halides are named in order of ascending concentrations.

The "aspect ratio" of a silver halide grain is the ratio of its equivalent circular diameter (ECD) to its thickness. The ECD of a grain is the diameter of a circle having an area equal to the projected area of the grain.

The "coefficient of variation" (COV) of silver halide grain size (ECD) is defined as 100 times the standard deviation of grain ECD divided by mean grain ECD.

The term "tabular grain" refers to a silver halide grain having two parallel crystal faces that are clearly larger than any remaining crystal faces and an aspect ratio of at least 2.

The term "tabular grain emulsion" refers to an emulsion in which tabular grains account for greater than 50% of total grain projected area.

The term "covering power" is used to indicate 100 times the ratio of maximum density to developed silver measured in $mg/dm^2$.

The term "colder" in referring to image tone is used to mean an image tone that has a more negative CIELAB b* value measured at a density of 1.0 above minimum density, where an optimally "cold" image tone is −6.5 or more negative. The measurement technique is described by Billmeyer and Saltzman, *Principles of Color Technology,* 2nd Ed., Wiley, N.Y., 1981, at Chapter 3. The b* values describe the yellowness vs. blueness of an image with more positive values indicating a tendency toward greater yellowness (image warmth).

*Research Disclosure* is published by Kenneth Mason Publications, Ltd., Dudley House, 12 North St., Emsworth, Hampshire P010 7DQ, England.

The present invention is useful for black-and-white development in any photographic silver halide material requiring at least one black-and-white development step. Such types of silver halide materials include, but are not limited to, particularly, radiographic films, aerial films, black-and-white motion picture films, duplicating and copy films, graphic arts films, positive- and negative-working microfilms and amateur and professional continuous tone black-and-white films. The invention is particularly useful for providing black-and-white images in radiographic films. The general composition of such materials is well known in the art but specific features that render them particularly adaptable to the present invention are described below in more detail.

In addition, the black-and-white developing composition of this invention can be used in the "first" (black-and-white) development of color reversal photographic silver halide materials (details described below).

The concentrated (first part) and working strength black-and-white developing compositions of this invention must contain one or more black-and-white developing agents, including dihydroxybenzene and derivatives thereof and ascorbic acid and derivatives thereof. Dihydroxybenzene and similar developing agents include hydroquinone and other derivatives readily apparent to one skilled in the art [see, for example, U.S. Pat. No. 4,269,929 (Nothnagle) and U.S. Pat. No. 5,457,011 (Lehr et al.)]. Hydroquinone is preferred.

"Ascorbic acid" developing agents are described in numerous publications including U.S. Pat. No. 5,236,816 (noted above) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al), EP-A-0 585,792 (published Mar. 9, 1994), EP-A-0 573 700 (published Dec. 15, 1993), EP-A-0 588 408 (published Mar. 23, 1994), WO 95/00881 (published Jan. 5, 1995), U.S. Pat. Nos. 5,089,819 and 5,278,035 (both of Knapp), U.S. 5,384,232 (Bishop et al), U.S. Pat. No. 5,376,510 (Parker et al), Japanese Kokai 7-56286 (published Mar. 3, 1995), U.S. Pat. No. 2,688,549 (James et al), U.S. Pat. No. 5,236,816 (noted above) and *Research Disclosure,* publication 37152, March 1995. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

The concentrated (first part) and working strength black-and-white developing compositions of this invention also preferably include one or more auxiliary co-developing agents that are also well known (for example, Mason, *Photographic Processing Chemistry,* Focal Press, London, 1975). Any auxiliary developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-hydroxymethyl-4-methyl-1-phenyl-3-pyrazolidone, 5-phenyl-3-pyrazolidone, 1-p-aminophenyl-4,4-dimethyl-3-pyrazolidone, 1-p-tolyl-4,4-dimethyl-3-pyrazolidone, 1-p-tolyl-4-hydroxymethyl-4-methyl-3-pyrazolidone, and 1-phenyl-4,4-dihydroxymethyl-3-pyrazolidone. Other useful auxiliary co-developing agents comprise one or more solubilizing groups, such as sulfo, carboxy or hydroxy groups attached to aliphatic chains or aromatic rings, and preferably attached to the hydroxymethyl function of a pyrazolidone, as described for example, in U.S. Pat. No. 5,837,434 (Roussilhe et al). A most preferred auxiliary co-developing agent is 4-hydroxymethyl-4-methyl-1-phenyl-3-pyrazolidone.

Less preferred auxiliary co-developing agents include aminophenols such as p-aminophenol, o-aminophenol, N-methylaminophenol, 2,4-diaminophenol hydrochloride, N-(4-hydroxyphenyl)glycine,p-benzylaminophenol hydrochloride, 2,4-diamino-6-methylphenol, 2,4-diaminoresorcinol and N-(β-hydroxyethyl)-p-aminophenol.

A mixture of different types of auxiliary developing agents can also be used if desired.

The concentrated (first part) and working strength developing compositions also preferably includes one or more preservatives or antioxidants. Various organic preservatives, such as hydroxylamine and alkyl- or aryl-derivatives thereof, can be used, and inorganic preservatives such as sulfites can be used. Sulfites are preferred. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Mixtures of these materials can also be used.

Examples of preferred sulfites include sodium sulfite, potassium sulfite, lithium sulfite, sodium bisulfite, potassium bisulfite, sodium metabisulfite, potassium metabisulfite, and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

Various known buffers, such as borates, carbonates and phosphates, or combinations of any of these can also be included in the compositions (both the concentrated first part and working strength compositions) to maintain the desired pH when in aqueous form. The pH can be adjusted with a suitable base (such as a hydroxide) or acid. The pH of the concentrated and working strength developing compositions (in aqueous form) are described below in TABLE I.

Optionally, the concentrated (first part) and working strength black-and-white developing compositions contain one or more sequestering agents that typically function to form stable complexes with free metal ions or trace impurities (such as silver, calcium, iron and copper ions) in solution that may be introduced into the developing composition in a number of ways. The sequestering agents, individually or in admixture, are present in conventional amounts. Many useful sequestering agents are known in the art, but particularly useful classes of compounds include, but are not limited to, multimeric carboxylic acids, polyphosphonic acids and polyaminophosphonic acids, and any combinations of these classes of materials as described in U.S. Pat. No. 5,389,502 (Fitterman et al), aminopolycarboxylic acids and polyphosphate ligands. Representative sequestering agents include ethylenediaminetetraacetic acid, diethylenetriaminepentaacetic acid, 1,3-propylenediaminetetraacetic acid, 1,3-diamino-2-propanoltetraacetic acid, ethylenediaminodisuccinic acid, ethylenediaminomonosuccinic acid, 4,5-dihydroxy-1,3-benzenedisulfonic acid, disodium salt (TIRON™), N,N'-1,2-ethanediylbis{N-[(2-hydroxyphenyl)methyl]}glycine ("HBED"), N {2-[bis(carboxymethyl)amino]ethyl}-N-(2-hydroxyethyl)glycine ("HEDTA"), N-{2-[bis(carboxymethyl)amino]ethyl}-N-(2-hydroxyethyl)glycine, trisodium salt (available as VERSENOL™ from Acros Organics, Sigma Chemical or Callaway Chemical), and 1-hydroxyethylidenediphosphonic acid (available as DEQUEST™ 2010 from Solutia Co.).

The black-and-white developing compositions (both concentrated and working strength compositions) can also contain other additives including various development restrainers, development accelerators, swelling control agents, dissolving aids, surface active agents, colloid dispersing aids, solubilizing solvents (such as glycols and alcohols), restrainers (such as sodium or potassium bromide), and sludge control agents (such as 2-mercaptobenzothiazole, 1,2,4-triazole-3-thiol, 2-benzoxazolethiol and 1-phenyl-5-mercatoetrazole), each in conventional amounts. Examples of such optional components are described in U.S. Pat. Nos. 5,236,816 (noted above), 5,474,879 (Fitterman et al), 5,837,434 (Roussilhe et al), Japanese Kokai 7-56286 and EP-A-0 585 792.

The black-and-white developing compositions (both first part concentrated and working strength compositions) of this invention can also include one or more photographic fixing agents (described below) to provide what is known in the art as "monobaths".

Two other essential components of the black-and-white developing compositions (first part and working strength compositions) of this invention (besides the black-and-white developing agent) are two organic antifoggants selected from each of two specific classes. More than one antifoggant from each class can be used also.

One antifoggant class includes mercapto-substituted tetrazoles that can have additional substituents as well. These compounds can be represented, for example, by the following Structure I:

I

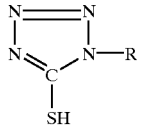

wherein R is hydrogen, a substituted or unsubstituted aliphatic group having up to 30 carbon, nitrogen, sulfur, and oxygen atoms, or a substituted or unsubstituted carbocyclic or heterocyclic group having up to 14 atoms in the ring system. Preferably, R is hydrogen, a substituted or unsubstituted alkyl group (having 1 to 16 carbon atoms), or a substituted or unsubstituted carbocyclic aryl group (having 6 to 14 carbon atoms in the ring system). Particularly useful "R" groups include substituted or unsubstituted methyl, ethyl, n-propyl, isopropyl, and phenyl groups. The "R" radicals can be substituted with one or more alkyl, aryl, halo, carboxy, sulfo, sulfonamido, carbonamido, amino, alkylcarbonyl, alkylsulfonyl, and other groups readily apparent to one skilled in the art.

Representative mercapto-substituted tetrazoles useful in the present invention include, but are not limited to, 1-phenyl-5-mercaptotetrazole [or phenyl-1-(1H)tetrazole-5-thiol], 1-(3-capramido)phenyl-5-mercaptotetrazole, 1-methyl-5-mercaptotetrazole, 1-(4-hydroxyphenyl)-5-mercaptotetrazole, 1-(2-dimethylaminoethyl)-5-mercaptotetrazole, 1-ethyl-5-mercaptotetrazole, 1-n-propyl-5-mercaptotetrazole, 1-(2-propyl)-5-mercaptotetrazole, and 1-(4-methylphenyl)-5-mercaptotetrazole. The first compound is most preferred in the practice of this invention.

The second class of antifoggants necessary in the practice of the present invention is a benzimidazole that is substituted with one or more electron withdrawing groups. The term "electron-withdrawing groups" for the present invention refers to monovalent radicals on the benzimidazole rings that have a Harnmett-sigma (δ) value of at least +0.5. Hammett-sigma values are standard values used to predict the electron withdrawing or electron donating effect of substituents on phenyl rings. Such values are known for many substituents [for example, see March, *Advanced Organic Chemistry: Reactions, Mechanisms, and Structure,* McGraw-Hill Book Company, New York, pp. 238–241, (1968) and Hansch et al., *Substituent Constants for Correlation Analysis in Chemistry,* John Wiley & Sons, New York, (1979)]. In addition, they can be calculated using standard procedures as described for example in *Steric Effects in Organic Chemistry,* John Wiley & Sons, Inc., pp. 570–574, 1956, and in *Progress in Physical Organic Chemistry,* vol. 2, Interscience Publishers, pp. 333–339, 1964.

Representative substituents that are sufficiently electron withdrawing groups for the present invention include, but are not limited to, nitro, nitroso, sulfo, sulfomoyl, cyano, carboxy, haloalkyl groups (such as trichloromethyl and trifluoromethyl), sulfoalkyl groups (such as sulfomethyl), carboxyalkyl groups (such as carboxymethyl), substituted amino groups (such as trimethylamino), and halo groups (such as fluoro, chloro, and bromo). Other useful groups within this definition would be readily understood by one skilled in the art. The preferred electron withdrawing groups are nitro, cyano, nitroso, trimethylamino, and trifluoromethyl groups. Nitro groups are the most preferred substituents.

These benzimidazoles can be represented by the following Structure II:

II

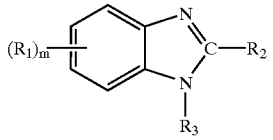

wherein $R_1$ is an electron withdrawing group (for example, as described above), $R_2$ and $R_3$ are independently hydrogen, a substituted or unsubstituted alkyl group having 1 to 16 carbon atoms(such as methyl, ethyl, n-propyl, iso-propyl, t-butyl, n-hexyl, dodecyl, 2-hydroxyethyl, and benzyl), or a substituted or unsubstituted aryl group (such as a phenyl or tolyl group). Also, m is an integer of from 1 to 4.

Preferably, in Structure II, $R_1$ is nitro, nitroso, trimethylamino, or trifluoromethyl, and m is 1 or 2. Most preferably, $R_1$ is nitro and m is 1. In addition, preferably, $R_2$ and $R_3$ is hydrogen, a substituted or unsubstituted alkyl group having 1 to 6 carbon atoms, or a substituted or unsubstituted phenyl group. More preferably, each of $R_2$ and $R_3$ is hydrogen, unsubstituted methyl, or unsubstituted phenyl.

Representative benzimidazoles useful in the practice of this invention include, but are not limited to, 5-nitrobenzimidazole, 5-nitrosobenzimidazole, 5-cyanobenzimidazole, 5-trifluoromethylbenzimidazole, and 5-trimethylaminobenzimidazole. The first compound is most preferred.

The working strength developing composition can be provided from the two concentrated components (or parts) where most of the chemical components are provided in the first part. However, the second part may be necessary to provide one or more gelatin hardening agents. Conventional hardeners can be used for this purpose. These include, but are not limited to, formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydro-quinoline, N-carbamoyl pyridinium salts, carbamoyl oxypyridinium salts, bis(imoniomethyl) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and copoly(acrolein-methacrylic acid). Glutaraldehyde is the most preferred gelatin hardening agent.

The second part can also include one or more preservatives (such as sulfites) or buffers as described above for the first part.

The working strength black-and-white photographic developing composition of this invention can be formulated with all of the desired components and chemicals without mixing the first and second parts described above. The gelatin hardening agent can be used in some embodiments, but may be omitted in other embodiments of this working strength composition.

The essential (and some preferred) components described above are present in the aqueous concentrated and working strength developing compositions in the general and preferred amounts listed in Tables I and II, all minimum and maximum amounts being approximate (that is, "about"). If formulated in dry form, the compositions would have the essential components in amounts readily apparent to one skilled in the art suitable to provide the desired liquid concentrations.

TABLE I (Concentrated Compositions)

| | General Amount | Preferred Amount |
|---|---|---|
| (Part I) | | |
| Developing agent | 0.6 to 1.2 mol/l | 0.8 to 1 mol/l |
| Auxiliary co-developing agent | 0.02 to 0.1 mol/l | 0.04 to 0.06 mol/l |
| Mercapto-substituted tetrazole antifoggant | 0.5 to 1.2 mmol/l | 0.7 to 1 mmol/l |
| Preservative (e.g. sulfite ions) | 1 to 1.6 mol/l | 1.1 to 1.4 mol/l |
| Buffer | 0.04 to 0.6 mol/l | 0.15 to 0.4 mol/l |
| Benzimidazole | 0.5 to 3 mmol/l | 0.8 to 2 mmol/l |
| Bromide ions | 0 to 0.4 mol/l | 0.1 to 0.2 mol/l |
| Glycol solubilizing solvent | 0.4 to 1.1 mol/l | 0.6 to 1.1 mol/l |
| pH | 9 to 12 | 10 to 12 |
| Part II | | |
| Gelatin Hardening Agent | 0.1 to 2 mol/l | 0.6 to 1.2 mol/l |
| Sulfite ions | 0.4 to 4.5 mol/l | 1.25 to 2.6 mol/1 |
| pH | 3 to 7 | 3 to 5 |

TABLE II

| Developing Composition (Parts I & II) | (Working Strength) General Amount | Preferred Amount |
|---|---|---|
| Developing agent | 0.16 to 0.3 mol/l | 0.2 to 0.25 mol/l |
| Auxiliary co-developing agent | 0.005 to 0.025 mol/l | 0.01 to 0.015 mol/l |
| Mercapto-substituted tetrazole antifoggant | 0.1 to 0.3 mmol/l | 0.15 to 0.25 mmol/l |
| Preservative (e.g. sulfite ions) | 0.25 to 0.6 mol/l | 0.35 to 0.5 mol/l |
| Buffer | 0.01 to 0.15 mol/l | 0.05 to 0.1 mol/l |
| Benzimidazole antifoggant | 0.1 to 0.75 mmol/l | 0.2 to 0.5 mmol/l |
| Bromide ions | 0 to 0.09 mol/l | 0.025 to 0.045 mol/l |
| Glycol solubilizing solvent | 0.09 to 0.4 mol/l | 0.12 to 0.3 mol/l |
| Gelatin hardening agent | 0 to 0.1 mol/l | 0.01 to 0.06 mol/l |
| pH | 9 to 12 | 10 to 11 |

Within the concentrated first part developing composition of this invention, the molar ratio of the mercapto-substituted tetrazole antifoggant to the substituted benzimidazole antifoggant is from about 1:20 to about 20:1, and preferably from about 1:1 to about 3:1.

A preferred concentrated first part developing composition is an aqueous composition having a pH of from about 10 to about 12 and comprising:

a) from about 0.8 to about 1 mol/l of a hydroquinone developing agent, b) from about 0.7 to about 1 mmol/l of phenyl-1(H) tetrazole, 1-thiol, c) from about 0.8 to about 2 mmol/l of 5-nitrobenzimidazole, d) from about 1.1 to about 1.4 mol/l of a sulfite preservative, and e) from about 0.04 to about 0.06 mol/l of a 3-pyrazolidone co-developing agent, wherein the molar ratio of phenyl-1(H) tetrazole, 1-thiol to 5-nitrobenzimidazole is from about 1:1 to about 3:1.

To use the present invention, the working strength composition of the present invention can be prepared using the noted chemical components in the noted amounts and used within a short period of time. However, it is preferred to mix the first and second parts, in diluted form, to provide a working strength composition. The two "parts" can be stored for longer periods of time and used all at once or in portions. The first part is generally diluted for from about 1 to about 10 times with water (or buffer), and the second part is generally diluted for from about 10 to about 25 times with water (or buffer), prior to or during mixing of the two parts.

In most processing methods in which the developing composition of this invention is used, its use is generally followed by a fixing step using a photographic fixing composition containing a photographic fixing agent. While sulfite ion sometimes acts as a fixing agent, the fixing agents generally used are thiosulfates (including sodium thiosulfate, ammonium thiosulfate, potassium thiosulfate and others readily known in the art), cysteine (and similar thiol containing compounds), mercapto-substituted compounds (such as those described by Haist, *Modern Photographic Processing,* John Wiley & Sons, N.Y., 1979), thiocyanates (such as sodium thiocyanate, potassium thiocyanate, ammonium thiocyanate and others readily known in the art), amines or halides. Mixtures of one or more of these classes of photographic fixing agents can be used if desired. Thiosulfates and thiocyanates are preferred. In a some embodiments, a mixture of a thiocyanate (such as sodium thiocyanate) and a thiosulfate (such as sodium thiosulfate) is used. In such mixtures, the molar ratio of a thiosulfate to a thiocyanate is from about 1:1 to about 1:10, and preferably from about 1:1 to about 1:2. The sodium salts of the fixing agents are preferred for environmental advantages.

The fixing composition can also include various addenda commonly employed therein, such as buffers, fixing accelerators, sequestering agents, swelling control agents, and stabilizing agents, each in conventional amounts. In its aqueous form, the fixing composition generally has a pH of at least 4, preferably at least 4.5, and generally less than 6, and preferably less than 5.5.

Processing can be carried out in any suitable processor or processing container for a given type of photographic element (for example, sheets, strips or rolls). The photographic material is generally bathed in the processing compositions for a suitable period of time.

In processing black-and-white photographic materials, development and fixing are preferably, but not essentially, followed by a suitable washing step to remove silver salts dissolved by fixing and excess fixing agents, and to reduce swelling in the element. The wash solution can be water, but preferably the wash solution is acidic, and more preferably, the pH is 7 or less, and preferably from about 4.5 to about 7, as provided by a suitable chemical acid or buffer.

After washing, the processed elements may be dried for suitable times and temperatures, but in some instances the black-and-white images may be viewed in a wet condition.

For example, exposure and processing of radiographic films can be undertaken in any convenient conventional manner. The exposure and processing techniques of U.S. Pat. Nos. 5,021,327 (Bunch et al.) and 5,576,156 (Dickerson), are typical for processing radiographic films. Other processing compositions (both developing and fixing compositions) are described in U.S. Pat. Nos. 5,738,979 (Fitterman et al), 5,866,309 (Fitterman et al), 5,871,890 (Fitterman et al), 5,935,770 (Fitterman et al), 5,942,378 (Fitterman et al), all incorporated herein by reference. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Bames et al) and EP-A-0 248,390 (Akio et al).

The compositions of this invention can be used in both what are known as "slow access" and "rapid access" processing methods and equipment. For example, black-and-white motion picture films, industrial radiographic films and professional films and papers are generally developed over a longer period of time (for example, for at least 1 minute and up to 12 minutes). Total processing including other steps (for example fixing and washing) would be even longer.

"Rapid-access" methods are generally used to process medical radiographic X-ray films, graphic arts films and microfilms and development may be at least 10 seconds and up to 60 seconds (preferably from about 10 to about 30 seconds). The total processing time (for example including fixing and washing) is as short as possible, but generally from about 20 to about 120 seconds. An example of a "rapid access" system is that commercially available as the KODAK RP X-OMAT™ processing system that also includes a conventional photographic fixing composition.

For either type of processing method, the development temperature can be any temperature within a wide range as known by one skilled in the art, for example from about 15 to about 50° C.

In general, such elements, emulsions, and layer compositions are described in many publications, including *Research Disclosure,* publication 36544, September 1994.

The black-and-white photographic silver halide elements processed using the present invention are generally composed of a conventional flexible, transparent film support (polyester, cellulose acetate or polycarbonate) that has applied to each side one or more photographic silver halide emulsion layers. For radiographic films, it is conventional to use blue-tinted support materials to contribute to the blue-black image tone sought in fully processed films. Polyethylene terephthalate and polyethylene naphthalate are preferred film supports. Thus, the support can take the form of any conventional element support. Useful supports can be chosen from among those described in *Research Disclosure,* September 1996, Item 38957 XV. Supports and *Research Disclosure,* Vol. 184, August 1979, Item 18431, XII. Film Supports. They can be transparent or translucent polymeric film supports, or opaque cellulosic papers. The support is preferably a transparent film support. In its simplest possible form the film support consists of a material chosen to allow direct adhesion of the hydrophilic silver halide emulsion layers or other hydrophilic layers. More commonly, the support is itself hydrophobic and subbing layers are coated thereon to facilitate adhesion of the hydrophilic silver halide emulsion layers.

The photographic materials include one or more silver halide emulsion layers that comprise one or more types of silver halide grains responsive to suitable electromagnetic radiation. Such emulsions include silver halide grains composed of, for example, silver bromide, silver iodobromide, silver chlorobromide, silver iodochlorobromide, and silver chloroiodobromide, or any combinations thereof. The silver halide grains in each silver halide emulsion unit (or silver halide emulsion layers) can be the same or different, or mixtures of different types of grains.

The silver halide grains can have any desired morphology (for example, cubic, tabular, octahedral), or mixtures of grains of various morphologies.

Imaging contrast can be raised by the incorporation of one or more contrast enhancing dopants. Rhodium, cadmium, lead and bismuth are all well known to increase contrast by restraining toe development. Rhodium is most commonly employed to increase contrast and is specifically preferred.

A variety of other dopants are known individually and in combination, to improve contrast as well as other common properties, such as speed and reciprocity characteristics. Dopants capable providing "shallow electron trapping" sites commonly referred to as SET dopants are specifically contemplated. SET dopants are described in *Research Disclosure,* Vol. 367, Nov. 1994, Item 36736. Iridium dopants are very commonly employed to decrease reciprocity failure. A summary of conventional dopants to improve speed, reciprocity and other imaging characteristics is provided by *Research Disclosure,* Item 36544, cited above, Section I. Emulsion grains and their preparation, sub-section D. Grain modifying conditions and adjustments, paragraphs (3), (4) and (5).

Low COV emulsions can be selected from among those prepared by conventional batch double-jet precipitation techniques. A general summary of silver halide emulsions and their preparation is provided by *Research Disclosure,* Item 36544, cited above, Section I. Emulsion grains and their preparation. After precipitation and before chemical sensitization the emulsions can be washed by any convenient conventional technique using techniques disclosed by *Research Disclosure,* Item 36544, cited above, Section III. Emulsion washing.

The emulsions can be chemically sensitized by any convenient conventional technique as illustrated by *Research Disclosure,* Item 36544, Section IV. Chemical sensitization. Sulfur and gold sensitization is specifically contemplated.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 36544, Section VII. Antifoggants and stabilizers, and Item 18431, Section II. Emulsion Stabilizers, Antifoggants and Antikinking Agents.

The silver halide emulsion and other layers forming the layers on the support contain conventional hydrophilic colloid vehicles (peptizers and binders) that are typically gelatin or a gelatin derivative (identified herein as "gelatino-vehicles"). Conventional gelatino-vehicles and related layer features are disclosed in *Research Disclosure*, Item 36544, Section II. Vehicles, vehicle extenders, vehicle-like addenda and vehicle related addenda. The emulsions themselves can contain peptizers of the type set out in Section II noted above, paragraph A. Gelatin and hydrophilic colloid peptizers. The hydrophilic colloid peptizers are also useful as binders and hence are commonly present in much higher concentrations than required to perform the peptizing function alone. The gelatino-vehicle extends also to materials that are not themselves useful as peptizers. The preferred gelatino-vehicles include alkali-treated gelatin, acid-treated gelatin or gelatin derivatives (such as acetylated gelatin and phthalated gelatin). Depending upon the use of the materials, the binder-containing layers can be hardened or unhardened.

Some photographic materials can include a surface overcoat on each side of the support that are typically provided for physical protection of the emulsion layers. In addition to vehicle features discussed above the overcoats can contain various addenda to modify the physical properties of the overcoats. Such addenda are illustrated by *Research Disclosure,* Item 36544, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of surface overcoat addenda, such as anti-matte particles, in the interlayers.

Examples of black-and-white papers and films that can be processed using the present invention include, but are not limited to, KODAK TRI-X-PAN Black and White Film, KODAK PLUS X-PAN Black and White Film, KODAK TMAX 100 and 400 speed Black and White Films, KODAK POLYMAX II RC Black and White Papers, KODAK KODABROME II RC F Black and White Paper, KODAK PMAX Art RC V Black and White Paper, KODAK POLY-CONTRAST III RC Black and White Paper, KODAK PANALURE Select RC Black and White Paper, KODAK POLYMAX FINE ART Black and White Papers, KODAK AZO Black and White Papers, ILFORD MULTIGRADE IV RC and FB Black and White Papers, ILFORD ILFO-BROME GALARIE Black and White Papers, and AGFA MULTICONTRAST CLASSIC, PREMWUM Black and White Papers.

The radiographic elements preferably processed according to this invention comprise a support having a single silver halide emulsion unit on each side thereof Such units include one or more silver halide emulsion layers. Further details of the support and silver halide emulsion units are provided below. In operation, such an element is generally included in an exposure assembly that also includes one or more intensifying screens in front or back of the element. The element and front and back screens are usually mounted in direct contact in a suitable cassette. X-radiation in an imagewise pattern is passed through and partially absorbed in the front intensifying screen, and a portion of the absorbed X-radiation is re-emitted as a visible light image that exposes the silver halide emulsion units of the element. X-radiation that is not absorbed by the front screen passes through the element with minimal absorption to reach the back intensifying screen. A substantial portion of that radiation is absorbed by the back screen and a portion of it is re-emitted as visible light image that also exposes the silver halide emulsion units of the element.

In their simplest construction, the radiographic films include a single silver halide emulsion layer on each side of the support. Preferably, however, there is also an interlayer and a protective overcoat on each side the support. General features of radiographic films are described in U.S. Pat. No. 5,871,892 (Dickerson et al.), which is incorporated herein by reference with respect to those films.

Any conventional transparent radiographic or photographic film support can be employed in constructing the films. Radiographic film supports usually exhibit these specific features: (1) they are constructed of polyesters to maximize dimensional integrity and (2) they are blue tinted to contribute the cold (blue-black) image tone sought in the fully processed films. Radiographic film supports, including the incorporated blue dyes that contribute to cold image tones, are described in *Research Disclosure,* Item 18431, cited above, Section XII. Film Supports. *Research Disclosure,* Vol. 365, September 1994, Item 36544, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly (ethylene naphthalate) are specifically preferred polyester film supports.

The transparent support can be subbed using conventional subbing materials that would be readily apparent to one skilled in the art.

The emulsion layers in the radiographic materials contain the light-sensitive high silver bromide relied upon for image formation. To facilitate rapid access processing the grains preferably contain less than 2 mol % (mole percent) iodide, based on total silver. The silver halide grains are predominantly silver bromide in content. Thus, the grains can be composed of silver bromide, silver iodobromide, silver chlorobromide, silver iodochlorobromide, silver chloroiodobromide or silver iodochlorobromide as long as bromide is present in an amount of at least 95 mol % (preferably at least 98 mol %) based on total silver content.

In addition to the advantages obtained by composition selection described above it is specifically contemplated to employ silver halide grains that exhibit a coefficient of variation (COV) of grain ECD of less than 20% and, preferably, less than 10%. It is preferred to employ a grain population that is as highly monodisperse as can be conveniently realized.

In addition, at least 50% (and preferably at least 70%) of the silver halide grain projected area is provided by tabular grains having an average aspect ratio greater than 8, and preferably greater than 12. Tabular grains are well known and described in numerous publications including, but not limited to, U.S. Pat. Nos. 4,414,310 (Dickerson), 4,425,425 (Abbott et al.), 4,425,426 (Abbott et al.), 5,021,327 (Bunch et al.), 5,147,771 (Tauer et al.), and 5,582,965 (Deaton et al.), incorporated herein by reference.

Both silver bromide and silver iodide have significant native sensitivity within the blue portion of the visible spectrum. Hence, when the emulsion grains contain high (>50 mol %, based on total silver) bromide concentrations, spectral sensitization of the grains is not essential, though still preferred. It is specifically contemplated that one or more spectral sensitizing dyes will be absorbed to the surfaces of the grains to impart or increase their light-sensitivity. Ideally the maximum absorption of the spectral sensitizing dye is matched (e.g., within ±10 nm) to the principal emission band or bands of the fluorescent intensifying screen. In practice any spectral sensitizing dye can be employed which, as coated, exhibits a half peak absorption bandwidth that overlaps the principal spectral region(s) of emission by a fluorescent intensifying screen intended to be used with the first radiographic film.

A wide variety of conventional spectral sensitizing dyes are known having absorption maxima extending throughout the near ultraviolet (300 to 400 nm), visible (400 to 700 nm) and near infrared (700 to 1000 nm) regions of the spectrum. Specific illustrations of conventional spectral sensitizing dyes is provided by *Research Disclosure,* Item 18431, Section X. Spectral Sensitization, and Item 36544, Section V. Spectral sensitization and desensitization, A. Sensitizing dyes.

The radiographic films generally include a surface overcoat on each side of the support that is typically provided for physical protection of the emulsion layers. In addition to vehicle features discussed above the overcoats can contain various addenda to modify the physical properties of the overcoats. Such addenda are illustrated by *Research Disclosure,* Item 36544, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of surface overcoat addenda, such as anti-matte particles, in the interlayers.

Some conventional radiographic materials that can be processed using the present invention include, but are not limited to, various KODAK T-MAT Radiographic Films, various KODAK INSIGHT Radiographic Films, KODAK X-OMAT Duplicating Film, various KODAK EKTASCAN Radiographic Films, KODAK CFT, CFL, CFS and CFE Radiographic Films, KODAK EKTASPEED and EKTASPEED PLUS Dental Films, KODAK ULTRASPEED Dental Film, KODAK X-OMAT K Film, KODAK X_OMAT UV Film, KODAK Min-R 2000 Mammography Film, and KODAK Min-R L Mammography Film.

The black-and-white developing composition can also be used in the first development step to provide color positive images using color reversal photographic silver halide materials.

Such materials are usually processed using the following sequence of processing steps: first (or black-and-white) development, washing, reversal re-exposure, color development, bleaching, fixing, washing and/or stabilizing. Another useful process has the same steps, but stabilizing is carried out between color development and bleaching. Such conventional steps are described, for example, in U.S. Pat.

Nos. 4,92 1,779 (Cullinan et al.), 4,975,356 (Cullinan et al.), 5,037,725 (Cullinan et al.), 5,523,195 (Dannon et al.) and 5,552,264 (Cullinan et al.) for the processing of color reversal films (using the conventional Process E-6). Other details are provided in *Research Disclosure,* publication 38957 (noted above), and references noted therein.

Some specific commercially available color reversal photographic films that can be processed using this invention include EKTACHROME and KODACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (Imation).

Advantageously, the concentrated compositions (both first and second parts) of this invention can be included as part of a processing kit that includes one or more additional photographic processing compositions needed for providing the desired images. For example, additional photoprocessing compositions include photographic fixing compositions for processing black-and-white photographic materials, or photographic color developing, bleaching, fixing and reversal compositions for processing color reversal photographic materials. The kit may also include washing solutions, instructions, fluid or composition metering devices, or any other conventional components of a photographic processing kit. All of the components can be suitably packaged in dry or liquid form in glass or plastic bottles, fluid-impermeable packets or vials.

The following examples are provided for illustrative purposes and are not to be considered limiting in any manner.

EXAMPLES 1–3

Concentrated black-and-white developing compositions (first part or Part A) were prepared having the components described in TABLES III and IV below. The various antifoggant combinations that were tried are noted in TABLE IV. A concentrated second part (Part B) used in the practice of the invention is shown in TABLE V below.

TABLE III

| COMPONENT | AMOUNT (mol/l) |
|---|---|
| Hydroquinone | 0.9 |
| 4-Hydroxymethyl-4-methyl-1-phenyl-3-pyrazolidone (HMMP) | 0.05 |
| Potassium bromide | 0.135 |
| Potassium sulfite | 1.25 |
| Sodium carbonate buffer | 0.28 |
| Diethylene glycol | 0.85 |
| First antifoggant | see TABLE IV |
| Second antifoggant | see TABLE IV |
| pH | 11 |

TABLE IV

| Developer | PMT (mmol/l) | 5-NIDAZ (mmol/l) | DEAMT (mmol/l) | 5-MeBTAZ (mmol/l) | 5-NBIMAZ (mmol/l) | BIMAZ (mmol/l) | 5-CBIMAZ (mmol/l) | 2-BIMAZT (mmol/l) |
|---|---|---|---|---|---|---|---|---|
| Control A | 0.16 | 0.61 | 0 | 0 | 0 | 0 | 0 | 0 |
| Control B | 0.16 | 0.37 | 0 | 0 | 0 | 0 | 0 | 0 |
| Control C | 0.18 | 0 | 0 | 0 | 0 | 0 | 0 | 0 |
| Control D | 0.22 | 0 | 0 | 0 | 0 | 0 | 0 | 0 |
| Control E | 0.18 | 0 | 0 | 0.45 | 0 | 0 | 0 | 0 |
| Control F | 0.18 | 0 | 0 | 1.35 | 0 | 0 | 0 | 0 |
| Example 1 | 0.18 | 0 | 0 | 0 | 0.44 | 0 | 0 | 0 |
| Example 2 | 0.16 | 0 | 0 | 0 | 0.36 | 0 | 0 | 0 |
| Example 3 | 0.18 | 0 | 0 | 0 | 0.26 | 0 | 0 | 0 |
| Control G | 0.20 | 0 | 0 | 0 | 0 | 0.42 | 0 | 0 |
| Control H | 0.20 | 0 | 0 | 0 | 0 | 0 | 0 | 0.40 |
| Control I | 0 | 0 | 0.18 | 0 | 0.26 | 0 | 0 | 0 |
| Control J | 0.18 | 0 | 0 | 0 | 0 | 0 | 0.26 | 0 |

"PMT" is phenyl-1(1H)tetrazole-5-thiol.
"5-NIDAZ" is 5-nitroindazole.
"DEAMT" is 1-(2-dimethylaminoethyl)-1(1H)tetrazole-5-thiol.
"5-MeBTAZ" is 5-methylbenzotriazole.
"5-NBIMAZ" is 5-nitrobenzimidazole.
"5-CBIMAZ" is benzimidazole carboxylic acid.
"BIMAZ" is benzimidazole.
"2-BIMAZT" is 2-benzimidazolethiol.

TABLE V

| COMPONENT | AMOUNT (mol/l) |
|---|---|
| Glutaraldehyde | 0.9 |
| Potassium sulfite | 1.9 |
| pH | 4 |

EXAMPLE 4

The concentrated first parts (Part A) shown in Examples 1–3 were diluted 4 times with water, and the concentrated second part (Part B) was diluted 20 times with water, and the two diluted parts were mixed to provide working strength developing compositions, both within and outside the scope of the present invention.

Several conventional radiographic films were imagewise exposed by a card control sensitometer (CCS #5), and processed in conventional KODAK 270RA processor in its standard cycle. The various working strength compositions were used for developing the images, and conventional KODAK RP X-OMAT LO Fixer was used for the fixing step, both steps at standard times and temperatures. TABLE VI below shows the results of processing the imagewise exposed "Insight" (KODAK INSIGHT Thoracic Imaging Film), "Min-R 2000" (KODAK Min-R 2000 Mammography Film), and "XUV" (KODAK O-MAT UV blue sensitive general use film) films.

In TABLE VI, the sensitometric results were determined as follows:

"Fog" (or base plus fog) was determined to be was determined to be the optical density of the film base plus the density of the emulsion layers in areas that have not been intentionally exposed.

"Speed" was determined as the exposure required to provide a density of 1.00 above the base plus fog of the film.

"CT" (contrast) was determined as the slope of the characteristic density vs. log E curve, measured between the two points that have an optical density equal to 2.00 and 0.25 above the base plus fog density.

"LSC" (lower scale contrast) was determined as the slope of the characteristic density vs. log E curve, measured between points that have lower density (optical density equal to 1.00 and 0.40) above the base plus fog density (also referred to as the "toe" contrast).

"UDP" was determined as the upper density point or maximum density of the characteristic density vs. log E curve.

"Image tone" was determined as a b* value measured at a density of 1.0 above minimum density. The b* value describes the yellow vs. blue color of an image where more positive values indicate a tendency towards a yellow image, or a "warmer" image.

TABLE VI

| Film | Developer | Fog | Speed | CT | LSC | UDP | Image Tone |
|---|---|---|---|---|---|---|---|
| Insight | Control A | 0.34 | 413 | 1.50 | 1.05 | 3.64 | −6.750 |
| Insight | Control B | 0.32 | 416 | 1.50 | 1.06 | 3.69 | −7.291 |
| Insight | Control C | 0.82 | 416 | 1.38 | 1.17 | 3.67 | −7.647 |
| Insight | Control D | 1.06 | 406 | 1.71 | 1.18 | 3.67 | — |
| Insight | Control E | 1.07 | 402 | 1.42 | 1.20 | 3.65 | −7.762 |
| Insight | Control F | 0.93 | 403 | 1.38 | 1.18 | 3.67 | — |
| Insight | Example 1 | 0.32 | 408 | 1.51 | 1.07 | 3.60 | −6.629 |
| Insight | Example 2 | 0.33 | 411 | 1.48 | 1.05 | 3.63 | −7.167 |
| Insight | Example 3 | 0.32 | 412 | 1.50 | 1.06 | 3.65 | — |
| Insight | Control G | 1.01 | 408 | 1.41 | 1.15 | 3.69 | — |
| Insight | Control H | 0.95 | 396 | 1.42 | 1.16 | 3.60 | — |
| Insight | Control I | 0.43 | 416 | 1.44 | 1.06 | 4.60 | −6.804 |
| Insight | Control J | 1.16 | 401 | 1.39 | 1.17 | 3.67 | −7.784 |
| Min-R 2000 | Control A | 0.21 | 420 | 3.85 | 2.29 | 4.01 | −10.206 |
| Min-R 2000 | Control B | 0.21 | 420 | 3.82 | 2.29 | 4.14 | −10.201 |
| Min-R 2000 | Control C | 0.21 | 424 | 3.36 | 2.143 | 3.99 | −10.249 |
| Min-R 2000 | Control D | 0.21 | 423 | 3.22 | 2.03 | 3.96 | −9.9554 |
| Min-R 2000 | Control E | 0.21 | 423 | 3.13 | 2.02 | 4.11 | — |
| Min-R 2000 | Control F | 0.21 | 422 | 3.22 | 2.14 | 4.23 | — |
| Min-R 2000 | Example 1 | 0.21 | 419 | 3.80 | 2.29 | 4.01 | −9.565 |
| Min-R 2000 | Example 2 | 0.21 | 421 | 3.80 | 2.28 | 3.97 | −9.962 |
| Min-R 2000 | Example 3 | 0.21 | 421 | 3.81 | 2.28 | 4.04 | — |
| Min-R 2000 | Control G | 0.22 | 424 | 3.26 | 2.06 | 3.99 | — |
| Min-R 2000 | Control H | 0.21 | 410 | 3.89 | 2.32 | 3.94 | — |
| Min-R 2000 | Control I | 0.23 | 425 | 3.46 | 2.21 | 4.05 | −10.014 |
| Min-R 2000 | Control J | 0.22 | 424 | 3.21 | 2.02 | 4.07 | −10.339 |
| XUV | Control A | 0.29 | 488 | 2.54 | 1.94 | 3.91 | — |
| XUV | Control B | 0.25 | 483 | 2.78 | 2.02 | 3.67 | — |
| XUV | Control C | 0.38 | 488 | 2.26 | 1.71 | 3.76 | — |
| XUV | Control D | 0.39 | 486 | 2.27 | 1.70 | 3.77 | — |
| XUV | Control E | 0.33 | 485 | 2.12 | 1.61 | 3.83 | — |
| XUV | Control F | 0.27 | 481 | 2.14 | 1.73 | 3.87 | — |
| XUV | Example 1 | 0.25 | 479 | 2.64 | 1.98 | 3.87 | — |
| XUV | Example 2 | 0.26 | 483 | 2.58 | 1.95 | 3.74 | — |
| XUV | Example 3 | 0.27 | 482 | 2.64 | 1.97 | 3.81 | — |
| XUV | Control G | 0.45 | 489 | 2.23 | 1.74 | 3.78 | — |
| XUV | Control H | 0.32 | 467 | 2.01 | 1.70 | 3.42 | — |
| XUV | Control I | 0.41 | 490 | 2.32 | 1.81 | 3.73 | — |
| XUV | Control J | 0.63 | 484 | 2.10 | 1.84 | 3.71 | — |

*"Insight" image tone values were high and inaccurate on strips with high $D_{min}$ (or fog).

The data in TABLE VI provide the following information about the present invention. The developing compositions identified as Examples 1–3 provided unexpected synergistic results, especially with the "Min-R 2000" film. Fog was low, contrast was greater than 3.8, and the image tone was blue (−10.2). In addition, the speed and $D_{max}$ were acceptable. The combination of the two antifoggants used in Examples 1–3 also provided good results with the other two films that were imaged and processed. In addition, an alkaline solution of 5-nitrobenzimidazole was stable after keeping for 12 weeks at 20° C.

In order to accommodate concentrated compositions in two parts, it was necessary to formulate both antifoggants in the first part (Part A). This part is extremely alkaline in pH, and under those conditions it was discovered that indazole type antifoggants, such as 5-nitroindazole ("5-NIDAZ"), had limited stability under those conditions. Compositions like Controls A and B showed significant degradation after 12 weeks of keeping at 20° C. By "degradation" is meant decomposition to non-active by-products. The indazole compounds are well known to be useful as antifoggants as described for example in U.S. Pat. No. 4,323,642 (noted above). When the Control A and B compositions were used in initial fresh conditions, log fog, high contrast, and "cold" (more blue) image tones could be obtained.

"PMT" was also used alone in the developing compositions (Controls C and D). It is a known active antifoggant and generally provides increased contrast and contributes to a "cold" (more blue) image tone. However, in the noted developing compositions, increasing its concentration had a very negative effect with higher fog and very low contrast in the processed films. In the mammography film ("Min-R 2000"), the primary negative effect was in the lowered contrast.

When a mixture of "PMT" and a benzotriazole, namely 5-methylbenzotriazole ("5-MeBTAZ") was used (Controls E and F), the contrast was very low in the "Min-R 2000" film and the "XUV" film. Fog was too high in the "Insight" film.

When an unsubstituted benzimidazole ("BIMAZ) was used with "PMT" in Control G, the sensitometric results, such as fog in the "Insight" film and contrast in the "Min-R 2000" film, were poor. Similar undesirable results were observed with Control H in which another benzimidazole ("2-BIMAZT") outside the scope of this invention was used with "PMT".

The properties and sensitometric results of various antifoggant combinations can be summarized in the following TABLE VII.

TABLE VI

| First Antifoggant | Second Antifoggant | Blue Image Tone | High Contrast/Low Fog | Solution Stability |
|---|---|---|---|---|
| PMT | IDAZ | Yes | Yes | No |
| PMT | BTAZ | Yes | No | Yes |
| PMT | 5-BIMAZ | Yes | Yes | Yes |
| PMT | None | Yes | No | Yes |
| BTAZ | IDAZ | No | No | No |
| BTAZ | 5-BIMAZ | No | No | Yes |
| BTAZ | None | No | No | Yes |
| IDAZ | 5-BIMAZ | No | No | No |
| IDAZ | None | No | No | No |
| PMT | BIMAZ | Yes | No | Yes |
| PMT | 2-BIMAZT | Yes | No | Yes |

The invention has been described in detail with particular reference to certain preferred embodiments thereof, but it will be understood that variations and modifications can be effected within the spirit and scope of the invention.

We claim:

1. A two-component black-and-white developing composition kit consisting of:

I) a first component comprising a concentrated composition having a pH of at least 9 and comprising:

a) at least 0.6 mol/l of a black-and-white developing agent, b) at least 0.5 mmol/l of a mercapto-substituted tetrazole antifoggant, and c) at least 0.5 mmol/l of a benzimidazole antifoggant having one or more withdrawing groups, and II) a second component comprising a concentrated composition having a pH of at least 3 and comprising at least 0.01 mol/l of a gelatin hardening agent.

2. The developing composition kit of claim 1 wherein said gelatin hardening agent is glutaraldehyde.

3. The kit of claim 1, wherein said black-and-white developing agent is present in an amount of from about 0.6 to about 1.2 mol/l, said mercapto-substituted tetrazole antifoggant is present in an amount of from about 0.5 to about 1.2 mmol/l, or said benzimidazole antifoggant being present in an amount of from about 0.5 to about 3 mmol/l.

4. The kit of wherein the molar ratio of said mercapto-substituted tetrazole antifoggant to said benzimidazole antifoggant is from about 1:20 to about 20:1.

5. The kit of claim 1 wherein the molar ratio of said mercapto-substituted tetrazole antifoggant to said benzimidazole antifoggant is from about 1:1 to about 3:1.

6. The kit of claim 1 wherein said first component has a pH of from about 10 to about 12.

7. The kit of claim 1, wherein said first component further comprises a sulfite preservative in an amount of at least 1 mol/l, or an auxiliary co-developing agent in an amount of at least 0.02 mol/l.

8. The kit of claim 7, wherein said sulfite preservative is present in an amount of from about 1 to about 1.6 mol/l, or an auxiliary co-developing agent in an amount of from about 0.02 to about 0.1 mol/l.

9. The kit of claim 1 wherein said mercapto-substituted tetrazole antifoggant is represented by the following Structure I:

I

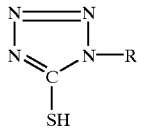

wherein R hydrogen or an aliphatic, carbocyclic, or heterocyclic group.

10. The kit of claim 9 wherein R is hydrogen, or an alkyl or carbocyclic aryl group.

11. The kit of claim 10 wherein R is a methyl, ethyl, n-propyl, iso-propyl, or phenyl group.

12. The kit of claim 1 wherein said mercapto-substituted tetrazole antifoggant is 1-phenyl-5-mercaptotetrazole, 1-(3-capramido)phenyl-5-mercaptotetrazole, 1-methyl-5-mercaptotetrazole, 1-(4-hydroxyphenyl)-5-mercaptotetrazole, 1-(2-dimethylaminoethyl)-5-mercaptotetrazole, 1-ethyl-5-mercaptotetrazole, 1-n-propyl-5-mercaptotetrazole, 1-(2-propyl)-5-mercaptotetrazole, or 1-(4-methylphenyl)-5-mercaptotetrazole.

13. The kit of claim 1, wherein said benzimidazole antifoggant is represented by the following Structure II:

II

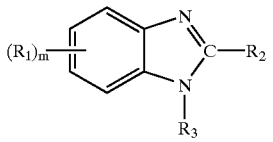

wherein $R_1$ is an electron withdrawing group, $R_2$ and $R_3$ are independently hydrogen, an alkyl group, or an aryl group, and m is an integer of 1 or 4.

14. The kit of claim 13 wherein $R_1$ is a nitro, nitroso, sulfo, sulfomoyl, cyano, carboxy, haloalkyl group, sulfoalkyl group, carboxyalkyl group, substituted amino group, or halo group, $R_2$ and $R_3$ are independently hydrogen, an alkyl group of 1 to 6 carbon atoms, or a phenyl group, and m is 1 or 2.

15. The kit of claim 14 wherein $R_1$ is nitro, nitroso, trimethylamino, or trifluoromethyl group, $R_2$ and $R_3$ are hydrogen, unsubstituted methyl, or unsubstituted phenyl, and m is 1.

16. The kit of claim 1 wherein said benzimidazole antifoggant is 5-nitrobenzimidazole, 5-nitrosobenzimidazole, 5-trifluoromethylbenzimidazole, 5-trimethylaminobenzimidazole, and 5-cyanobenzimidazole.

17. A two-component black-and-white photographic developing composition kit consisting of:

I) a first component comprising a concentrated composition having a pH of from about 10 to about 12 and comprising:

a) from about 0.8 to about 1 mol/l of a hydroquinone developing agent, b) from about 0.7 to about 1 mmol/l of phenyl-1(H) tetrazole, 1-thiol, c) from about 0.8 to about 2 mmol/l of 5-nitrobenzimidazole, d) from about 1.1 to about 1.4 mol/l of a sulfite preservative, and e) from about 0.04 to about 0.06 mol/l of a 3-pyrazolidone co-developing agent, wherein the molar ratio of phenyl-1(H) tetrazole, 1-thiol to 5-nitrobenzimidazole is from about 1:1 to about 3:1, and II) a second component comprising a concentrated composition having a pH of at least 3 and comprising at least 0.01 mol/l of an aldehyde gelatin hardening agent.

* * * * *